United States Patent [19]

Cabaraux et al.

[11] 3,983,026

[45] Sept. 28, 1976

[54] ELECTROLYTIC CELLS WITH VERTICAL ELECTRODES

[75] Inventors: Emile Cabaraux; Robert Schoberle, both of Brussels, Belgium

[73] Assignee: Solvay & Cie, Belgium

[22] Filed: Oct. 7, 1974

[21] Appl. No.: 512,912

[30] Foreign Application Priority Data

Oct. 19, 1973 Belgium ..... 136867

[52] U.S. Cl. ..... 204/258; 204/252; 204/266; 204/275; 204/286

[51] Int. Cl.[2] ..... C25B 1/26; C25B 9/02

[58] Field of Search ..... 204/242, 252, 266, 275, 204/286, 258

[56] References Cited

UNITED STATES PATENTS

| | | | |
|---|---|---|---|
| 3,342,717 | 9/1967 | Leduc | 204/252 X |
| 3,425,927 | 2/1969 | Currey | 204/252 X |
| 3,591,483 | 7/1971 | Loftfield et al. | 204/252 |
| 3,658,686 | 4/1972 | Schoberle | 204/286 |
| 3,847,783 | 11/1974 | Giacopelli | 204/252 X |

FOREIGN PATENTS OR APPLICATIONS

| | | | |
|---|---|---|---|
| 1,127,484 | 9/1968 | United Kingdom | 204/266 |
| 1,160,999 | 8/1969 | United Kingdom | 204/266 |

*Primary Examiner*—John H. Mack
*Assistant Examiner*—A. C. Prescott
*Attorney, Agent, or Firm*—Robert E. Burns; Emmanuel J. Lobato; Bruce L. Adams

[57] ABSTRACT

A unipolar electrolytic cell having a baseplate and anode plates disposed parallel and substantially vertically. Each anode plate is mounted on at least one anode support fixed to the baseplate and leakproof thereon. Each anode plate is connected to at least one current lead disposed beneath the baseplate. The cathodes of the cell alternate with the anodes. A casing above the baseplate surrounds the anode plates and cathodes. A cover is provided above the casing and conduits for admission of a solution to be electrolyzed and for removal of the products of electrolysis. The current lead rests on a fixed prop and supports an anode support. The anode support passes through the baseplate and support at least a part of the baseplate above the current lead.

13 Claims, 3 Drawing Figures

ELECTROLYTIC CELLS WITH VERTICAL ELECTRODES

BACKGROUND OF THE INVENTION

The present invention relates to improvements in electrolytic cells with vertical electrodes, more particularly in cells furnished with metal anodes and intended for the production of alkali metal chlorate or hypochlorite or the production of chlorine.

It is known to employ metal anodes in cells electrolysing aqueous solutions of alkali metal halide. These anodes, for example, consist of plates of platinum or of plates of a film-forming metal such as titanium covered with an active coating comprising a metal or a compound of a metal of the platinum group. These metal anodes also sometimes contain a core of a metal that is cheaper and has a better electrical conductivity, such as copper or aluminium.

Until now, the development of cells with metal anodes has been relatively slow, because of the difficulties encountered in fixing these anodes inside the cell and connecting them to a current lead. Various solutions have been proposed to resolve these difficulties, but none of them seem to have given full satisfaction up to now.

In British Patent Specification No. 1,125,493 of Imperial Metal Industries (Kynoch) Limited it is proposed, for example, to fix the anodes by bolting, riveting or welding on to a titanium plate which forms the base of the cell and is anchored on a concrete foundation. The current is led to the anodes by bars of copper or aluminium, embedded in the concrete foundation and welded to the lower face of the titanium plate vertically beneath the anodes.

The construction of an anode assembly of this type is costly and difficult. It necessitates firm anchorage of the titanium plate on the concrete foundation, in order to prevent the plate from deforming and causing a lateral displacement of the anodes during operation of the cell.

This known anode assembly has the further disadvantage that is entails significant energy losses through the Joule effect, owing to passage of the current from the current leads to the anodes through the titanium sheet of low electrical conductivity.

It has also been proposed, in Belgium Pat. No. 739420, to mount the metal anodes on vertical anode supports and to support the latter on a rigid metallic foundation, which is covered by a protective insulating layer and forms the base of the cell. The rigid metallic foundation may, for example, be made of copper or aluminium and may then serve also as the current lead to the anodes, or alternatively current leads may be suspended beneath the foundation from extensions of the anode support.

This known anode assembly has the double disadvantage of being heavy and costly, because of the great thickness necessary in the metallic foundation in order to ensure that it has sufficient rigidity.

Furthermore, during operation of the cell, the large sized metallic foundation is inevitably the seat of a gradient of internal stresses of thermal origin, which can lead to its deformation and to a lateral displacement of the anodes in the cell.

SUMMARY OF THE INVENTION

The present invention overcomes the said disadvantages of the known cells.

According to the present invention there is therefore provided an electrolytic cell comprising a baseplate, substantially vertical and parallel anode plates, each one mounted on at least one anode support which is fixed in leakproof manner to the baseplate and is connected to at least one current lead beneath the baseplate, cathodes alternating with the anodes, a casing above the baseplate surrounding the anodes and the cathodes, a cover above the casings and conduits for admitting a solution for electrolysis and for removing the products of electrolysis, characterized in that the current lead rests on at least one prop and supports the anode support and that the anode support passes through the baseplate and supports at least a part of the baseplate.

In the cell according to the invention the current lead serves as the support for the anodes in the cells. Therefore the baseplate functions only as a leakproof wall of the cell. It does not need to take part in supporting the anodes nor in conducting the electric current between the current lead and the anodes. It is supported in areas close to each other by the said anode supports.

The cell according to the invention thus has the advantage of allowing the use of a thin baseplate, of moderate mechanical strength, just sufficient to withstand the hydrostatic pressure ruling in the cell, between the zones where it is fixed to the anode supports.

In one particular embodiment of the cell according to the invention at least part of the baseplate is made of a flexible sheet. This embodiment of the invention has the advantage of allowing local deformation of the baseplate, arising for example from the effect of thermal expansions, without interfering with the position of the anodes in the cells. It has the additional advantage of allowing precise adjustment of the anode in the cell, between the cathodes. For this purpose, according to one advantageous feature of the invention, the aforesaid prop for the current lead is adjustable in height.

In the cell according to the invention it is purely a matter of choice whether the baseplate is made of an electrically conducting material of an insulating material. Preferably, it is made of a film-forming metal, such as titanium, tantalum, niobium and their alloys.

BRIEF DESCRIPTION OF THE DRAWINGS

Further features and details of the invention will be apparent from the following description, presented by way of example, of several embodiments of the cell according to the invention, with reference to the accompanying drawings, in which like parts are numbered alike.

In the drawings.

DESCRIPTION OF THE PREFERRED EMBODIMENTS

All the figures relate to a diaphragm cell for the electrolysis of aqueous solutions of alkali metal halides, for example a sodium chloride brine. The cell comprises a framework 1 made up of an assembly of metal girders such as 2, 3, 4 and 5, which are welded together.

Figure 1:
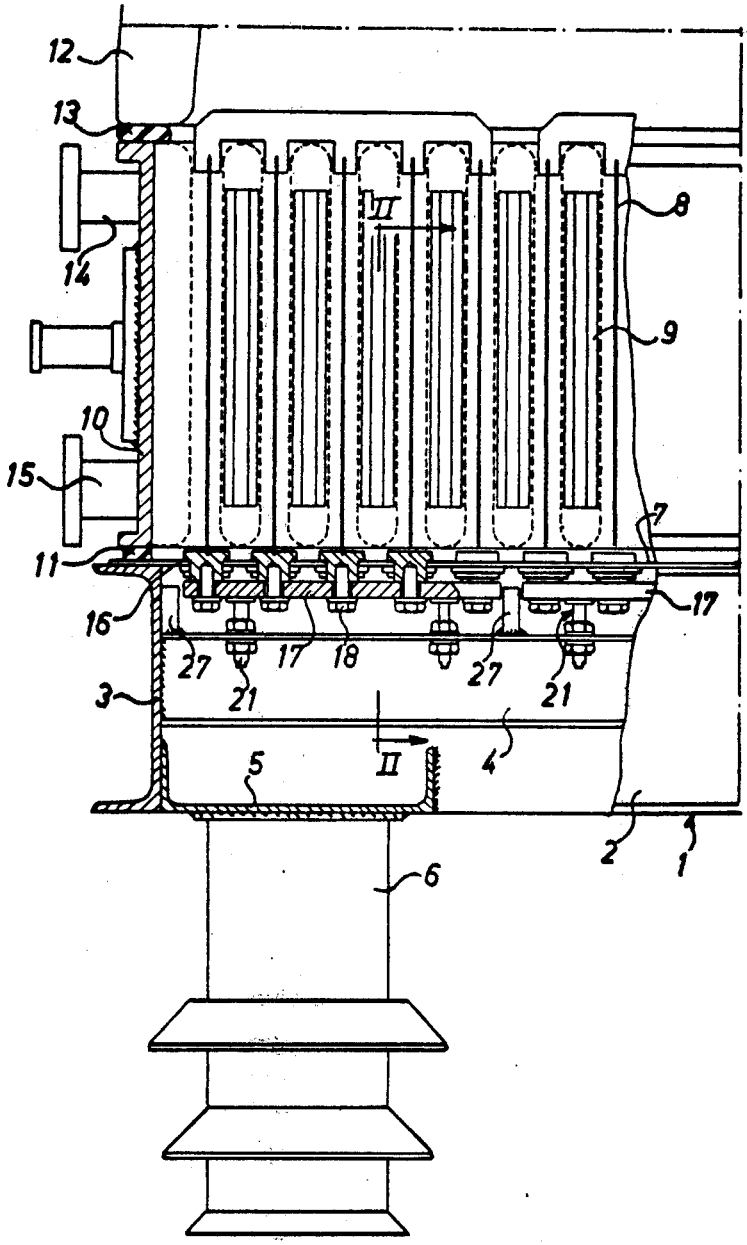
FIG. 1 shows, in transverse vertical section, part of a preferred embodiment of the cell according to the invention.

The framework 1 rests on insulators such as the one shown at 6 in FIG. 1. It supports at its periphery a titanium sheet 7, which forms the baseplate of the cell and is connected to the vertical metal anodes 8 in a manner which will be described below. The anodes 8 are for example formed, in known manner, from one or more plates of titanium covered over at least part of their faces with an active coating comprising for example a metal or a compound of a metal of the platinum group.

The anodes 8 alternate with cathode pockets 9, which have foraminous walls and are covered by a diaphragm (not shown). The cathode pockets 9 are fixed to a steel casing 10, which rests on the periphery of the framework 1 with interposition of a sealing joint 11. The cathode casing 10 is surmounted by a cover 12 with interposition of a sealing joint 13.

Figure 2:
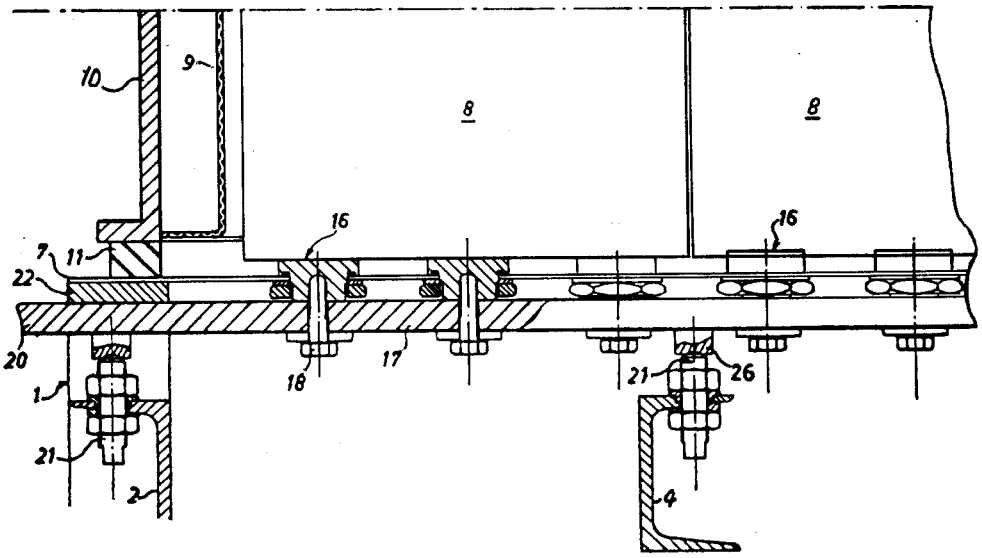
FIG. 2 is a longitudinal vertical section in the plane II — II of FIG. 1.

The cell shown in FIGS. 1 and 2 is in communication with conduits 14 and 15, provided respectively for the removal of hydrogen and alkaline liquor produced at the cathodes.

According to the invention, each anode plate 8 is mounted on anode supports consisting of a series of cylindrical rods of titanium, equally spaced from each other, for example three rods in the case of FIG. 2. These rods 16 pass through circular openings formed in the baseplate 7. They are supported, beneath the plate 7, on a bar 17, which serves as current lead to the anode. The cylindrical rods 16 are secured to the current lead-in bar 17 by means of bolts 18 passing through the bar 17 and each screwed into the axial threaded orifice 19 in a rod 16.

The current lead-in bar 17 is preferably made of copper or aluminium. It extends over the whole length of the cell, parallel to the anodes 8, the projects beyond the cell at one end 20 for connection to the positive pole of a direct current source or to the cathode casing of the neighbouring electrolytic cell. The bar 17 rests on a series of props 21.

Figure 3:
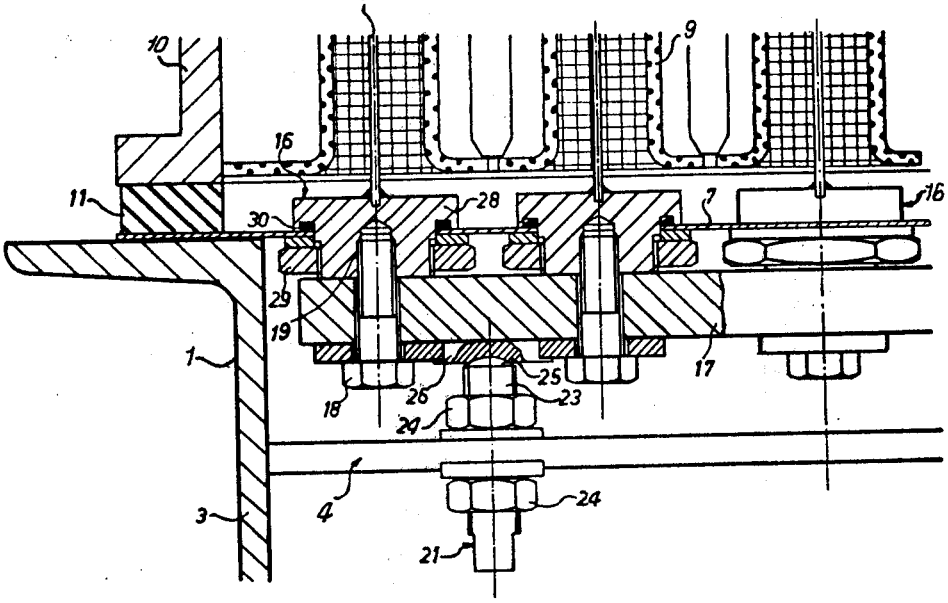
FIG. 3 shows, on a larger scale, a detail of FIG. 1.

The props, denoted in a general manner by the reference numeral 21, are made up of (FIG. 3) threaded vertical rods 23, each fixed by a pair of nuts 24 onto a limb 4 of the framework 1. The threaded rods 23 are terminated at their upper end by a spherical convex surface 25 co-operating with a corresponding concave surface of a small plate 26 fitted against the lower base of the current lead-in bar 17.

In the embodiment shown in FIG. 1, the cell according to the invention comprises a plurality of current lead-in bars 17 placed side by side and each supporting five rows of anodes. Laterally retaining elements 27, integral with the framework 1, ensure a correct lateral position of the bars 17 and consequently of the anodes 8 within the cell.

The titanium sheet 7 constitutes the base of the cell. It is supported by the rods 16 which pass through it. To effect this support the titanium sheet is clamped between an upper flange 28 on each rod 16 and a nut 29 screwed on to a corresponding threaded portion of the said rod. Sealing between the rod 16 and the baseplate 17 is ensured by means of an annular elastic joint 30 placed in a corresponding annular groove in the flange 28 opposite the plate 7.

During operation of the cell shown in the figures, the electric current passes successively through the current lead-in bars 17, the rods 16 and the anodes 18. the baseplate 7 not participating in conduction of the current.

In the cell shown in the figures, the props 21 for the bars 17 are adjustable in height by means of pairs of nuts 24. The presence of a plurality of nuts of this type beneath each bar 17 provides the important advantage of allowing easy and precise adjustment of the orientation of the bar 17 with reference to the horizontal plane, so as to ensure an optimum position of the anodes 8 between the cathodes 9.

In an advantageous variant of the invention, the baseplate 7 is flexible. The use of a flexible baseplate 7 gives the advantage of assisting the adjustment of the said orientation of the bars 17 by means of the props 21. Furthermore, it permits local deformation of the plate 7, for example under the influence of thermal expansions, without interfering with the sealing nor with the geometry of the cell.

According to a modified embodiment (not shown) of the cell according to the invention, the baseplate 7 is made of an electrically non-conducting material, which is resistant to corrosion by the electrolyte and the products of electrolysis. It is, for example made of a sheet of chlorinated polyvinylchloride or of polytetrafluoroethylene.

According to another embodiment (not shown) of the cell according to the invention, the rods 16 are made of a material of high electrical conductivity, for example copper or aluminium, and their upper part 28, intended to come into contact with the electrolyte, is covered with a leakprood protective coating which is resistant to corrosion by the electrolyte and the products of electrolysis. This protective coating may for example be made of chlorinated polyvinyl chloride, polytetrafluoroethylene or a film-forming metal such as titanium.

Whereas the embodiments of the invention described with reference to the accompanying drawings relates to diaphragm cells, the invention is equally applicable to cells with vertical electrodes that have no diaphragms, such as cells for the production of a chlorate of an alkali metal.

What we claim is:

1. A unipolar electrolytic cell comprising a baseplate, substantially vertical and parallel anode plates each of which is mounted on at least one anode support fixed in leakproof manner to the baseplate and connected to at least one current lead placed beneath the baseplate, cathodes alternating with the anode plates, a casing above the baseplate surrounding the anode plates and cathodes, a cover above the casing the conduits for admission of a solution to be electrolysed and for removal of the products of electrolysis, characterised in that the current lead rests on at least one fixed prop and supports and said anode support and that the said anode support passes through the baseplate and supports at least a part of the baseplate above the current lead.

2. An electrolytic cell according to claim 1, wherein the baseplate is supported at its edge beneath the casing on a rigid framework.

3. An electrolytic cell according to claim 2, wherein the said prop is fixed to the framework.

4. An electrolytic cell according to claim 2, wherein the current lead rests on at least three props that are adjustable in height independently of each other.

5. An electrolytic cell according to claim 1 wherein the said part of the baseplate consists of a flexible sheet of a material which is resistant to corrosion by the electrolyte and the products of electrolysis.

6. An electrolytic cell according to claim 5, wherein the said sheet is made of a film-forming metal.

7. An electrolytic cell according to claim 6, wherein the film-forming metal is titanium.

8. An electrolytic cell according to claim 5, wherein the said sheet is made of an insulating material.

9. An electrolytic cell according to claim 1 wherein at least that part of the anode support which lies above the baseplate is made of a film-forming metal.

10. An electrolytic cell according to claim 1 wherein the said prop is adjustable in height.

11. In a unipolar electrolytic cell comprising a baseplate, substantially vertical and parallel anode plates each of which is mountd on at least one anode support which is fixed in leakproof manner to the baseplate and is connected to at least one current lead placed beneath the baseplate, cathodes alternating with the anode plates, a casing above the baseplate surrounding the anode plates and cathodes, a cover above the casing and conduits for admission of a solution to be electrolysed and for removal of the products of electrolysis, the improvement consisting in that the current lead rests on at least one fixed prop and is releasably attached to and supports the said anode support and in that the said anode support passes through the baseplate and is releasably attached to and supports at least a part of the baseplate, above the current lead.

12. An electrolytic cell according to claim 11 wherein the anode support comprises a cylindrical rod which passes through a circular opening in the baseplate, and which is fixed on to the current lead by means of a bolt passing through the current lead and screwed into a corresponding threaded axial opening in the rod, the baseplate being clamped between an upper flange on the rod and a nut screwed on to a corresponding threaded portion of the rod.

13. An electrolytic cell according to claim 12, wherein the said flange on the rod has an annular groove facing the baseplate, in which an elastic sealing joint is inserted.

* * * * *